United States Patent [19]

Kunderman

[11] 4,279,574

[45] Jul. 21, 1981

[54] ENERGY RECOVERY SYSTEM

[75] Inventor: Fred K. Kunderman, Olean, N.Y.

[73] Assignee: Dresser Industries, Inc., Dallas, Tex.

[21] Appl. No.: 32,089

[22] Filed: Apr. 23, 1979

[51] Int. Cl.[3] ..... F04B 23/00

[52] U.S. Cl. ..... 417/243; 60/648; 62/238.6; 165/35; 165/DIG. 12; 237/1 R; 237/81

[58] Field of Search ..... 417/243; 62/238 E, 324; 60/648; 165/35, DIG. 12; 237/1 R, 81

[56] References Cited

U.S. PATENT DOCUMENTS

| | | | |
|---|---|---|---|
| 3,301,002 | 1/1967 | McGrath | 62/324 D X |
| 4,098,092 | 7/1978 | Singh | 62/324 D X |

FOREIGN PATENT DOCUMENTS

| | | | |
|---|---|---|---|
| 675840 | 5/1939 | Fed. Rep. of Germany | 417/243 |
| 225743 | 5/1943 | Switzerland | 417/243 |

*Primary Examiner*—Richard E. Gluck

*Attorney, Agent, or Firm*—Roy L. Van Winkle

[57] ABSTRACT

The system described is useful in connection with a gas compressor that has a heat exchanger. Water conduits, a water pump and water control valve and cooler are connected in such a manner that the water circulated through the heat exchanger is directed to an energy consumption device wherein the heat is extracted to heat a room, office or the like. The control valve and cooler are arranged in the conduit so that the energy consumption device can be selectively bypassed by all or a portion of the water, depending on the heating demand.

3 Claims, 2 Drawing Figures

ENERGY RECOVERY SYSTEM

BACKGROUND OF THE INVENTION

This invention relates generally to an improved system for recovering wasted energy from gas compressors or the like. More particularly, but not by way of limitation, this invention relates to a system for conserving wasted energy that utilizes energy in the form of heat that is extracted from a heat exchanger which cools the gas in the compressor for the purpose of heating an office or the like.

In the past, the hot gas passing through heat exchangers has been utilized for the purpose of preheating fuel in gas turbine engines. It is believed that no one has taken the cooling liquid, which becomes heated upon passing through the heat exchanger and stored such liquids for the purpose of using the heat energy therein to heat an office or the like.

The object of this invention is to provide an improved system for utilizing the wasted heat energy from gas compressors or the like.

SUMMARY OF THE INVENTION

This invention provides an improved system for recovering wasted energy from a gas compressor or the like. The system comprises a heat exchanger operably connected with a compressor, a water conduit system operably connected to the heat exchanger, energy consumption means connected with the conduit and water pump means connected with the conduit for circulating water through the heat exchanger and through the energy consumption means. The system also includes a control means operably connected with the conduit for selectively bypassing the energy consumption means.

BRIEF DESCRIPTION OF THE DRAWING

The foregoing and additional objects and advantages of the invention will become more apparent as the following detailed description is read in conjunction with the accompanying drawing, wherein like reference characters denote like parts in all views and wherein.

DETAILED DESCRIPTION OF THE PREFERRED EMBODIMENT

Figure 1:
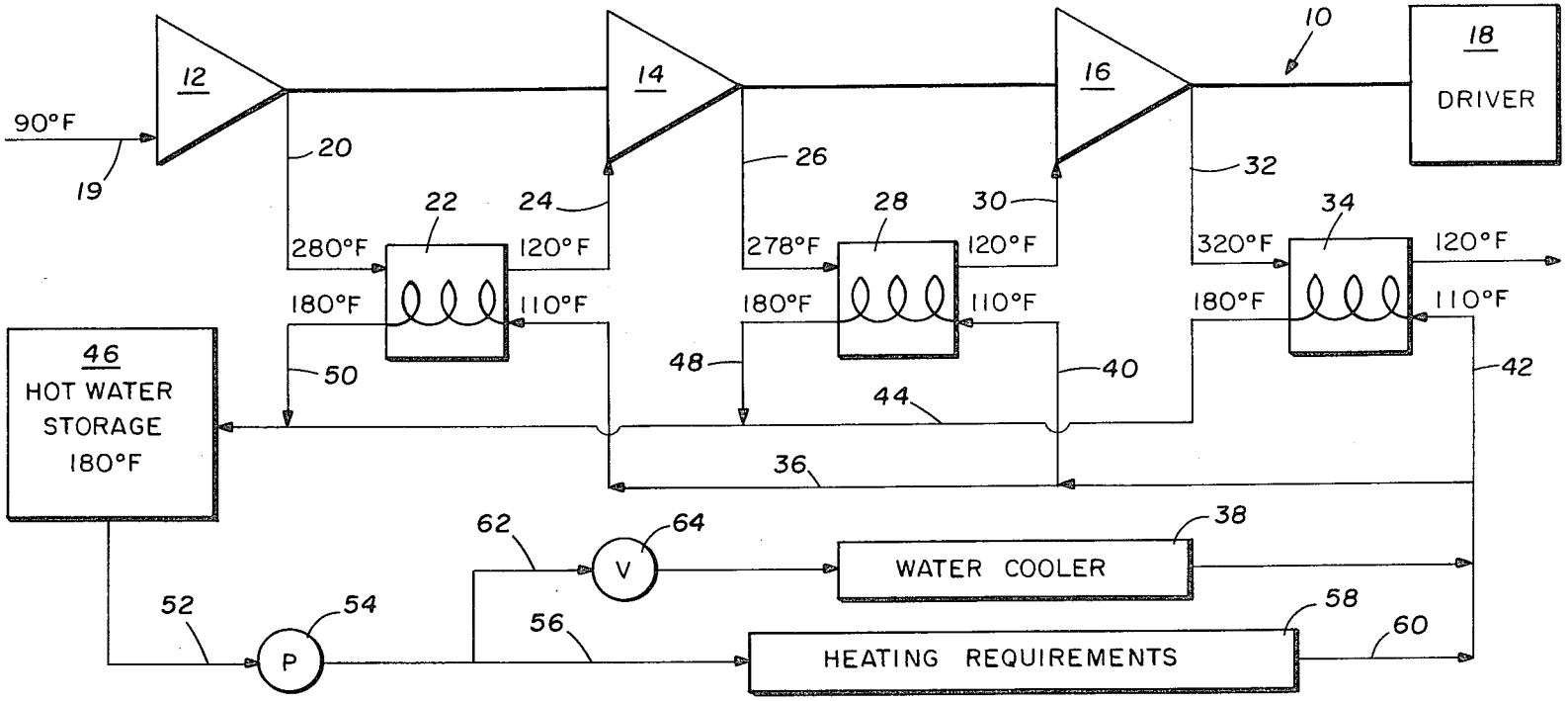
FIG. 1 is a schematic of a three-stage compressor utilizing a system for recovering wasted energy that is constructed in accordance with the invention.

Referring to the drawing and to FIG. 1 in particular, shown therein and generally designated by the reference character 10 is a compressor that includes a first stage 12, a second stage 14 and a third stage 16. A driver 18 is provided for causing rotation of the compressor 10.

The first stage 12 of the compressor 10 includes a gas inlet 19 and a gas outlet 20 that is connected to a heat exchanger or intercooler 22. The second stage 14 of the compressor 10 includes a gas inlet 24 that extends from the heat exchanger 22 and a gas outlet 26 that is connected to a heat exchanger or second intercooler 28. The third stage 16 of the compressor 10 includes a gas inlet 30 that is connected with an outlet from the heat exchanger 28 and includes a gas outlet 32 that is connected to a third heat exchanger or aftercooler 34.

Gases from the aftercooler 34 are delivered to the service point (not shown) for the compressed gases.

Each of the heat exchangers 22, 28 and 34 includes a liquid side, that is, each is provided with some means of passing liquid such as water therethrough for cooling the compressed gases. As illustrated, the heat exchanger 22 has its inlet water side connected by a conduit 36 to a water cooler 38 which may be a cooling tower or a water refrigeration system of any desired type. A branch conduit 40 connects the conduit 36 with the inlet to the heat exchanger 28 and a branch conduit 42 connects the conduit 36 with the inlet to the heat exchanger 34.

The outlet from the water side of the heat exchanger 34 is connected by conduit 44 with a hot water storage tank 46. Preferably, the hot water storage tank 46 will be suitably insulated to prevent heat loss from the water coming out of the exchangers.

A branch conduit 48 extends from the heat exchanger 28 in the connection with the conduit 44. The outlet of the water side of the heat exchanger 22 is connected by a branch conduit 50 with the conduit 44 and thereby with the hot water storage tank 46.

The hot water storage tank is connected by a conduit 52 with the water pump 54. The water pump 54 may be of any suitable type and may be driven by any desired means. The outlet of the water pump 54 is connected by a conduit 56 with an energy consumption device 58 for utilizing the energy from the hot water.

The device 58 could be a hot water heating system for a house, office or any other facility wherein it is necessary to provide an additional heat. The energy consumption device 58 is connected by a conduit 60 with the conduit 36 which returns the water to the heat exchangers. A branch conduit 62 connects the pump 54 with the water cooler 38 and, through the conduit 36, provides a means for bypassing the energy consumption device 58.

A control valve 64 is interposed in the conduit 62 so that hot water that is not needed in the energy consumption device 58 can be bypassed through the water cooler 38. Thus, the temperature of the water reentering the heat exchangers will be at a predetermined and desired temperature.

In operation, the compressor 10 is driven by the driver 18 and air, for example, is brought in at the inlet 19 to the first stage 12 wherein the air is compressed. During compression, heat is generated in air which exits at the outlet 20 from the first stage 12 entering the heat exchanger 22. Such air may be at about 280° F. as indicated, and leaves the heat exchanger 22 at approximately 120° F. due to the exchange of the heat with the water passing through the heat exchanger 22.

The air passes from the heat exchanger 22 into the second stage 14 wherein additional compression occurs. The air therefrom is at an increased temperature and exits through the outlet 26 into the second heat exchanger 28 at a temperature of approximately 278° F.

The gas leaves the heat exchanger 28 at approximately 120° F. entering the third stage 16 of the compressor 10. In the third stage 16, the pressure is again increased with the air exiting through the outlet 32 at approximately 320° F. into the heat exchanger or aftercooler 34 wherein the temperature is dropped to approximately 120° F. or at whatever temperature is desired for its end use.

As the air passes through the exchangers 22, 28 and 34, the water is flowing through the exchangers. The water inlet of each of the exchangers is placed in a parallel arrangement by the conduit system described so that the water entering each exchanger is at approximately the same temperature, that is, at about 110° F. The exchangers are each sized appropriately to provide for sufficient heat exchange to occur therein so that the water coming out of each heat exchanger will be approximately at 180° F. Also, as previously described, the circuits or conduits interconnecting the outlets of each of the exchangers is in a parallel arrangement so that the water delivered to hot water storage 46 is at approximately the exit temperature of each of the exchangers.

Since the energy consumption device 58 may not be able to consume all of the water at the elevated temperature, the bypass circuit is provided and includes the control valve 64 and the water cooler 38 which can be properly adjusted to reduce the temperature of the water being returned to the heat exchanger to the desired value or as illustrated, about 110° F.

From the foregoing, it will be apparent that the system will provide a considerable volume of water at an elevated temperature that can be utilized for the purpose of heating.

Figure 2:
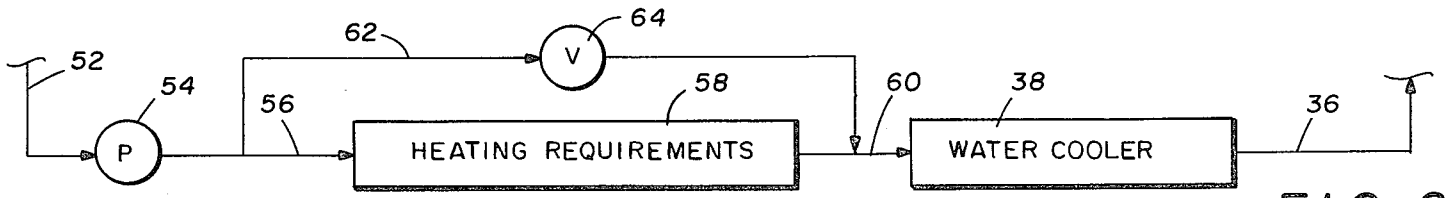
FIG. 2 is a partial schematic illustrating a modification of the system for recovering wasted energy illustrated in FIG. 1.

FIG. 2 illustrates an alternate arrangement for the control portion of the system. The same reference characters will be used in describing FIG. 2 as were used in FIG. 1, except where modifications or changes have been made.

As illustrated in FIG. 2, the pump 54 is connected by a conduit 52 with a hot water storage tank 46 as illustrated in FIG. 1. The conduit 56 connects the energy consumption device 58 with the pump 54 and a branch conduit 62 extends around the energy consumption device 58 joining with the conduit 60. The control valve 64 is interposed in the conduit 62 to control the volume of water flowing through the conduits 56 and 62. The water cooler 38 has been repositioned so that it is connected with the conduit 60 downstream of the energy consumption device 58 and of the bypass control circuit so that all of the water being returned to the heat exchangers will pass through the water cooler 38.

The operation of the modification of FIG. 2 is identical to that of the device of FIG. 1 with the exception of the control circuit previously mentioned.

From the foregoing, it can be appreciated that the invention described in detail provides an improved system for utilizing wasted energy from a compressor or the like. It should be apparent that the system described can be utilized with compressors or the like having any number of heat exchangers. It should be appreciated that many changes and modifications can be made thereto without departing from the spirit of the invention.

The embodiments of the invention in which are exclusive property or privilege is claimed are defined as follows:

1. A system for recovering wasted energy from a multi-stage gas compressor or the like and including means for driving the compressor, said system comprising:

heat exchanger means having a water inlet and outlet operably connected with each compression stage of the compressor;

water conduit means operably connected to said heat exchanger means providing a parallel flow arrangement for the inlet and outlet of said heat exchanger means;

energy consumption means connected with said conduit means;

water pump means connected with said water conduit means for circulating water through said heat exchanger means and through said energy consumption means; and control means operably connected with said conduit means for selectively bypassing said energy consumption means and comprising valve means located in said conduit means for controlling the quantity of water flowing through said energy consumption means and water cooling means for decreasing the temperature of water flowing in said conduit means to said heat exchanger means.

2. The system of claim 1 and also including insulated water storage means connected by said conduit means with the outlet of each said heat exchanger.

3. A system for recovering wasted energy from gas compressors having first, second and third stages of compression, each stage having a gas inlet and outlet and including means for driving the compressor, said system comprising:

a first heat exchanger operably connected between the outlet from the first stage and the inlet to the second stage;

a second heat exchanger operably connected between the outlet from the second stage and the inlet to the third stage;

a third heat exchanger operably connected to the outlet from the third stage; insulated water storage means having an inlet and an outlet;

water pump means having an inlet connected to the outlet from said water storage means, said pump means having an outlet;

energy consumption means having an inlet connected with the outlet from said pump means and having an outlet;

first water conduit means connecting said outlet from said energy consumption means with each said heat exchanger;

second water conduit means connecting each said heat exchanger with the inlet to said water storage means; and, water control means connected between the outlet from said pump means and said third heat exchanger for selectively bypassing said energy consumption means.

* * * * *